US010610765B2

(12) United States Patent
Beresford-Williams

(10) Patent No.: US 10,610,765 B2
(45) Date of Patent: Apr. 7, 2020

(54) POOL TABLE

(71) Applicant: Home Leisure Direct Limited, South Gloucestershire (GB)

(72) Inventor: Andrew Beresford-Williams, South Gloucestershire (GB)

(73) Assignee: Home Leisure Direct Limited, South Gloucestershire (GB)

( * ) Notice: Subject to any disclaimer, the term of this patent is extended or adjusted under 35 U.S.C. 154(b) by 0 days.

(21) Appl. No.: 16/517,495

(22) Filed: Jul. 19, 2019

(65) Prior Publication Data

US 2020/0023263 A1 Jan. 23, 2020

(30) Foreign Application Priority Data

Jul. 23, 2018 (GB) ..... 1811958.6

(51) Int. Cl.

| | |
|---|---|
| ***A63D 15/20*** | (2006.01) |
| ***A63D 15/06*** | (2006.01) |
| ***A63D 15/04*** | (2006.01) |
| ***A63D 15/00*** | (2006.01) |
| ***G07F 17/38*** | (2006.01) |
| ***A47B 85/06*** | (2006.01) |

(52) U.S. Cl.

CPC ..... *A63D 15/003* (2013.01); *A47B 85/06* (2013.01); *A63D 15/04* (2013.01); *G07F 17/38* (2013.01); *A47B 2200/0011* (2013.01); *A63D 15/06* (2013.01); *A63D 15/20* (2013.01)

(58) Field of Classification Search

CPC ..... A63D 15/002; A63D 15/04; A63D 15/20; A47B 85/06; A47B 2200/0011; G07F 17/38

USPC ..... 473/1, 21–27

See application file for complete search history.

(56) References Cited

U.S. PATENT DOCUMENTS 240,461 A * 4/1881 Reingardt ..... A63D 15/00 473/22
366,123 A * 7/1887 Marghieri ..... A63D 15/00 473/25
501,632 A * 7/1893 Torrey ..... A63B 71/0672 473/25

(Continued)

*Primary Examiner* — Mitra Aryanpour
(74) *Attorney, Agent, or Firm* — Sean D. Burdick

(57) ABSTRACT

A pool table has a removable dining surface and a gravity-based ball-return system located transversely between end legs of the pool table. Balls that have been pocketed during a game on the table's playing bed are commonly collected in one of inclined two gullies that connect together multiple pockets. The gullies are peripheral to the table and directly beneath pockets that are, preferably, either side of a central longitudinal axis of the table. The ball return system includes a stacked arrangement of runners that receive a pocketed ball from a cascading drop at the end of each gully. Once into the stack, a ball separation device identifies and selectively separates a cue ball from object balls, with the cue ball directed downwards towards a free-return box while object balls are directed along a different downward path. Object balls are then retained behind a ball retainer and release mechanism which, when in a release position, causes delivery of all object balls to a ball picking slot at an end of the pool table common with the free-return box. Pool table depth is therefore minimized while space under the table's bed is maximized to accommodate seating.

11 Claims, 6 Drawing Sheets

(56) References Cited

U.S. PATENT DOCUMENTS 626,902 A * 6/1899 Griffin ..... A63D 15/00 473/22
806,158 A * 12/1905 Mascher ..... A63D 15/00 473/22
808,051 A * 12/1905 Hege ..... A63D 15/00 473/25
971,128 A * 9/1910 Goss ..... A63D 15/00 473/25
980,989 A * 1/1911 Morris ..... A63D 15/00 473/25
1,201,382 A * 10/1916 Stump ..... A63D 15/00 473/25
1,266,012 A * 5/1918 Goss ..... A63D 15/00 473/25
1,367,441 A * 2/1921 Treiber ..... A63D 15/00 473/22
1,391,909 A * 9/1921 McCool ..... A63D 15/00 473/25
1,427,691 A * 8/1922 McCool ..... A63D 15/00 473/25
1,656,416 A * 1/1928 Brinkman ..... A47B 25/00 473/22
1,672,891 A * 6/1928 Kirin ..... A63D 15/02 473/22
1,842,080 A * 1/1932 Dunn ..... A63D 15/00 473/25
1,973,492 A * 9/1934 Linero ..... A63D 15/00 473/25
2,047,048 A * 7/1936 Abbott ..... A63D 15/003 473/22
2,165,875 A * 7/1939 Sawyer ..... A63D 15/00 473/15
2,348,267 A * 5/1944 Sikes ..... G07F 17/38 473/24
2,765,169 A * 10/1956 Wilhelm ..... A63D 15/00 473/24
3,140,093 A * 7/1964 Singer ..... A63F 7/06 473/5
3,439,915 A * 4/1969 Schweer ..... A63D 15/00 473/25
4,381,862 A * 5/1983 Rimmer ..... A63D 15/00 473/24
5,054,776 A * 10/1991 Wyman ..... A63D 15/04 473/34
6,149,530 A * 11/2000 Shih ..... A63D 15/00 473/22
2003/0130051 A1* 7/2003 Pearson ..... A63D 15/00 473/10

* cited by examiner

POOL TABLE

FIELD OF THE INVENTION

This invention relates, in general, to a pool table and is particularly, but not exclusively, applicable to a pool dining table having a ball-return and ball separation mechanism therewithin supporting pay-for-play.

SUMMARY OF THE PRIOR ART

Table pool is a game played on a flat table of a rectangular form in which a total of six pockets are dispersed one at each of the four corners of the table and two centrally on opposing sides of the major/longest side of the table. Sprung side cushions along the periphery of the table define curved edges to the pockets and are further designed to allow in-play pool balls (whether cue/white ball or an object color ball that is to be struck by the cue ball) to be bounced (doubled) off the cushions. To ensure a smooth roll of the balls, the pool table's surface preferably has a highly-toleranced flat slate "bed", although other dimensionally stable, non-warping materials (such as MDF) can also be used as a bed.

The [slate] bed is then covered in a baize, such as a fine wool nap.

Unsurprisingly, a standard-sized pool table (whether a US-sized 8-foot (2.4 m) or a UK-sized 2.14 m (7-foot) or some other size) is—or at least can be—of considerable weight. Once in situ and levelled—which is frequently time-consuming and far from straight forward—there is a clear preference not to move the pool table. Bed levelling may take two forms: course levelling using height-adjustable feet and/or fine internal levelling where shims or wedges are pushed between a bottom surface of the bed and supporting ledges and blocks on which the bed rests.

Pool tables have therefore evolved to permit their secondary use as a dining table, with this allowing pool tables to be more readily accommodated in homes and pubs or clubs to make use of limited space and/or by optimizing revenue streams for different times of the day, e.g. serving of meals in a pub restaurant at meal times or playing of pool as a social activity as the meal times pass.

Pool dining tables take two general forms.

First, there are reversible/rotatable pool tables where the entire table surface can be rotated about a central (usually major) axis and then locked in place. The rotation either reveals a flat dining table surface that closely aligns, in a horizontal plane, with side aprons of the pool table to provide a flat table top, or otherwise reveals a pool playing table having drop pockets into which balls are potted. In this system, there is no ball return mechanism and, consequently, no ability to install a pay-per-game mechanism because the balls are always accessible from reaching into the drop pockets. Such reversible systems must also be operated with a degree of care because the rotation of the table can produce a "nip" between the side apron and table that could sever a finger (if caught in the nip). Secure locking of such a reversible/rotatable table in a public space is therefore important because of this potential danger and related public liability.

The second form of pool dining table includes a secondary table top that is placed over the table and supported on the upper horizontal surfaces of the side aprons. Usually, the secondary surface is made from two or three pieces of flat timber boards that are interlocked together with laterally extending dowel pins and associated aligned dowel cavities.

An under-surface of these board may include downwardly projecting bracing elements that are arranged to be located in the near vicinity of the pool table's side cushions, thereby providing a keying element that prevents the assembled table top from moving, e.g. skewing.

Pool dining tables also must have sufficient leg clearance beneath the table to permit a person to be seated at the table (when it's used as a dining table with a chair or banquette seating). Typically, this floor to under-surface 'leg clearance' is about 60 cm (2 ft), with this allowing sufficient clearance for a person to be sat on a chair (which typically has a seat height to floor distance of about 40 cm (1.3 ft)). With this leg clearance requirement, conventional ball return mechanisms in pay-per-game tables are not viable since these mechanisms make use of a gravity drop to collect, hold and finally return pocketed pool balls and the depth of such "cabinet" systems large (i.e. in the region of 42 cm (1.4 ft) from an uppermost horizontal surface of the side aprons of the table). Consequently, the necessity for a shallow overall depth of a pool dining table sees the use of bucket-like drop pockets and thus continuous and direct access to all pocketed balls (accessible from a simply reach-in and hand extraction process).

With "coin-operated" systems where a payment (whether by coin or electronic transfer) is required for pay-per-game play, these systems have a suitably shaped and holed slate bed that rests on central and lateral cross-members fixed into the sides of the cabinet. Inclined generally U-shaped gullies beneath the pockets act as channels to direct a pocketed ball into a central collection box positioned centrally under the bed, with the central collection box itself containing at least one inclined surface running from an end towards the middle of the table. The inclination ensures that the balls run towards a cascading channel and ball run that is configured to move the balls lower (relative to the bed) and then finally towards a side of the pool table for secure ball retention or, in the case of the cue ball, towards one end of the table.

It is noted that the cascading channel includes a ball separation mechanism that operates to differentiate the cue ball from the object pool balls. This ball separation mechanism takes one of two usual forms that depends on whether the pool table in an "English" or "American" table. In the English version, the cue balls are marginally smaller than the colored balls, with this size difference allowing the cue ball to be sieved, using a suitably dimensioned hole in a run of the base of the cascading channel, to distinguish the cue ball and thereby to send the cue ball to a free-return box at one end of the table. In the American version, all balls are the same size, although the cue ball includes an internal magnetic or other internal identification device that interacts with a control gate to open or close the control gate at an appropriate time to cause re-direction only of the cue ball to the free-return box.

As to the colored balls, these are collected in an internal (typically transparent-sided) ball reservoir running along a side of the pool table and parallel to the major axis of the pool table. Once potted into a pocket, access to these color balls is restricted by a mechanically or electrically-operated telescopic rod located at a lowest end of the ball reservoir. With the rod extended, the balls are securely retained behind the rod on an inclined slope of the ball reservoir. When the telescopic rod is retracted for a timed period after payment has been received by the pool table, the gravity feed system allows the colored balls to run downwards (past the now retracted rod) and ultimately collect in a ball picking slot that is generally located at an opposite end of the table to the free-return box (for the cue ball). The telescopic rod is then reset in its extended position to cause subsequent collection of pocketed colored balls in the ball reservoir as the now authorized game progresses and colored balls are pocketed.

One further pool dining table design is the Montfort Lancaster. In this system, the table is shallow with all the balls (regardless of being colored or the cue ball) collected centrally beneath the table in a single collection box. A steel frame simply channels all balls into this collection box from the pockets. The collection box includes two symmetric S-shaped channels that store potted balls within the curves of the S, with the curves also used to slow the balls as they are rolled into the box. The collection box is hinged so that, when not in use, it can be accommodated within the bulk of the table. However, the position of the collection box is not easily accessible and, consequently, ball removal relatively difficult.

An explanation of pool table and particularly pool dining table construction can be found at www.homeleisuredirect-.com.

SUMMARY OF THE INVENTION

According to first aspect of the present invention there is provided pool table having a first end and a second end and connecting sides that connect the first end to the second end, the pool table including: a bed into which is cut six pockets, with one of said six pockets positioned at each one of at least four corners defined at intersections between connecting sides and one of the first end and the second end; a ball collection layer beneath the bed, the ball collection layer including: at least one downwardly inclined peripheral edge gully interconnecting multiple pockets, the at least one peripheral edge gully located beneath multiple pockets thereby to collect, in use, balls that fall into the pockets; a cascading drop at a lowest end of the at least one inclined peripheral edge gully, the cascading drop nearest one of said first end and second end; a ball separation, collection and dispensing sub-system positioned at one of said first end and said second end, the ball separation, collection and dispensing subsystem having: at least one ingress point beneath the cascading drop; a stacked arrangement of multiple downwardly inclined runners wherein a first one of said runners is beneath the at least one ingress point and wherein stacking of one runner over another runner causes a switchback; a ball separation device arranged to differentiate between a cue ball and an object ball, the ball separation device configured to send a cue ball along a first path in the stack towards a free-return box and to send object balls along a second path in the stack towards a ball picking slot, wherein the free-return box and the ball picking slot are accessible only at one of the first end and the second end of the table.

In an embodiment, a ball retainer and release mechanism cooperates with the ball separation, collection and dispensing subsystem, the ball retainer and release mechanism located in the second path and wherein the ball retainer and release mechanism is arranged to selectively retain object balls behind a barrier to prevent such retained object balls from being accessible, prior to release of the barrier, from the ball picking slot.

A payment device may be arranged to receive payment for a game, the payment device operatively coupled to the ball retainer and release mechanism and wherein, upon receipt of payment by the payment device, the barrier is opened to release retained object balls into the ball picking slot.

Typically, the ball collection layer includes two edge gullies that are mirror-images of one another along a major longitudinal axis of the pool table.

Preferably, the ball separation, collection and dispensing sub-system is located between a pair of legs, said legs being at corners of a short side of the pool table (which may be a pool dining table).

The first path is preferably different to the second path such that the free-return box is physically distinct from the ball picking slot.

The peripheral edge gully may further include an inclined ball deflector board that slopes inwardly from an outer edge of the table towards a centerline of the table.

Advantageously, the preferred embodiments allow production of a less bulky pool dining table that can accommodate for under-the-table seating and which can further support a ball return function that can distinguish between a cue ball and colored object balls in a fashion that securely captures and retains colored object balls, thereby allowing pay-per-game play, while making freely available the cue ball. Beneficially, the gravity-based system provides easy access to the cue ball and object balls at a height and logical location within a surface of the pool table.

The single-end ball separation, collection and dispensing sub-system makes use of a gravity-system through a respective succession of side edge gullies (that interconnect multiple pockets in a subset of total pockets) that feed end-stacked ball runs. This configuration eliminates the need for a central collection and permits the pool table to have an underneath clearance sufficient to allow seating of a chair therebeneath.

The pool table (or other ball-based game table) may be a pool dining table having a removable dining surface, has a gravity-based ball-return system located transversely/laterally between end legs of the pool table. Balls that have been pocketed during a game on the table's playing bed are commonly collected in one of inclined two gullies that connect together multiple pockets. The gullies are peripheral to the table and directly beneath pockets that are, preferably, either side of a central longitudinal axis of the table. The ball return system includes a stacked arrangement of runners that receive a pocketed ball from a cascading drop at the end of each gully. Once into the stack, a ball separation device identifies and selectively separates a cue ball from object balls, with the cue ball directed downwards towards a free-return box while object balls directed along a different downward path. Object balls are then retained behind a ball retainer and release mechanism which, when in a release position, causes delivery of all object balls to a ball picking slot at an end of the pool table common with the free-return box. Pool table depth is therefore advantageously minimized while space under the table's bed is maximized to accommodate seating.

BRIEF DESCRIPTION OF THE DRAWINGS

Exemplary embodiments of the present invention will now be described with reference to the accompanying drawings, in which.

DETAILED DESCRIPTION OF A PREFERRED EMBODIMENT

Figure 1:
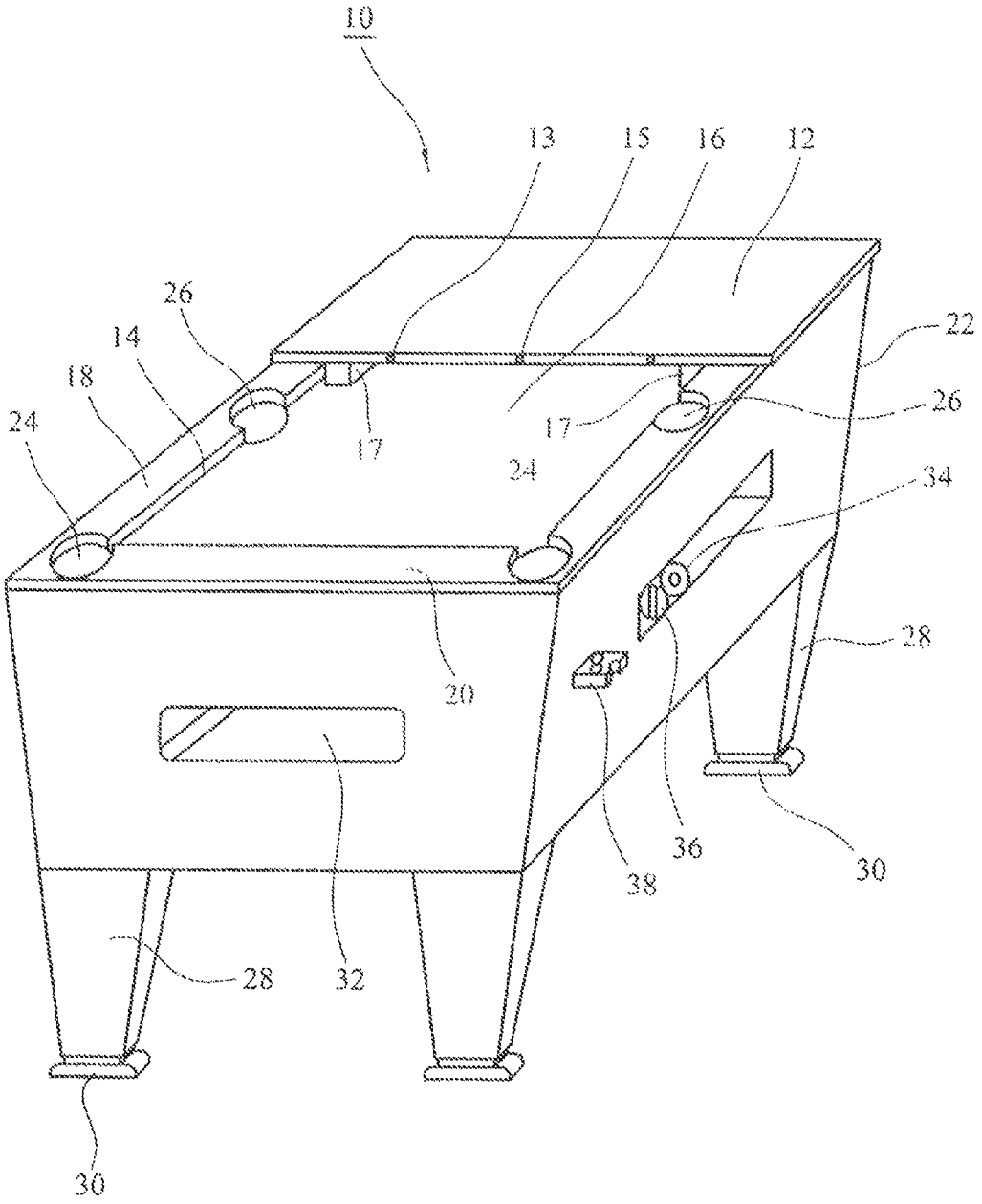
FIG. 1 PRIOR ART
FIG. 1 is a representation of a pay-per-game cabinet pool dining table shown to include a portion of a tabletop.

FIG. 1 is a representation of a prior art pay-per-game cabinet pool dining table 10 shown to include a portion of a lift-off tabletop 12, including a connecting dowel pin 13 and receptive dowel cavities 15 into which locate corresponding dowel pins on complementary and abutting tabletop portions (not shown). Two or three tabletop portions assemble to produce a uniform table top. Locking wooden keys 17, in the form of wooden blocks, extend from the underside of the tabletop and permit a relatively secure locking of the tabletop portions 12 against side aprons 18-20 of the pool table.

Conventionally, as is well-known, the pool table 10 includes a flat mechanically-stable bed 14 (typically of slate or the like) covered by a baize 16. Side aprons 18-20 define an upstanding cushion for the pool table 10, with these side aprons 18-20 and bed 14 secured to and supported by a cabinet 22. The pool table is conventionally rectangular in shape with a corner pocket 24 at each corner thereof and further side pockets 26 positioned midway along each of the major sides of the pool dining table 10.

The cabinet 22 includes the ball return system that is described later in relation to FIG. 2. In this respect, the cabinet shows a ball picking slot 32 at a first end of the pool table 10, and a ball reservoir 34 in which is retained (by way of example) two pool balls 36. A payment device 38, such as a coin-operated release slot or electronic card payment device, is associated with cabinet and is operable to receive payment for pay-per-game operation, as is readily understood. Typically, the cabinet is itself supported by corner legs 28 each having adjustable-levelling feet 30.

Figure 2:
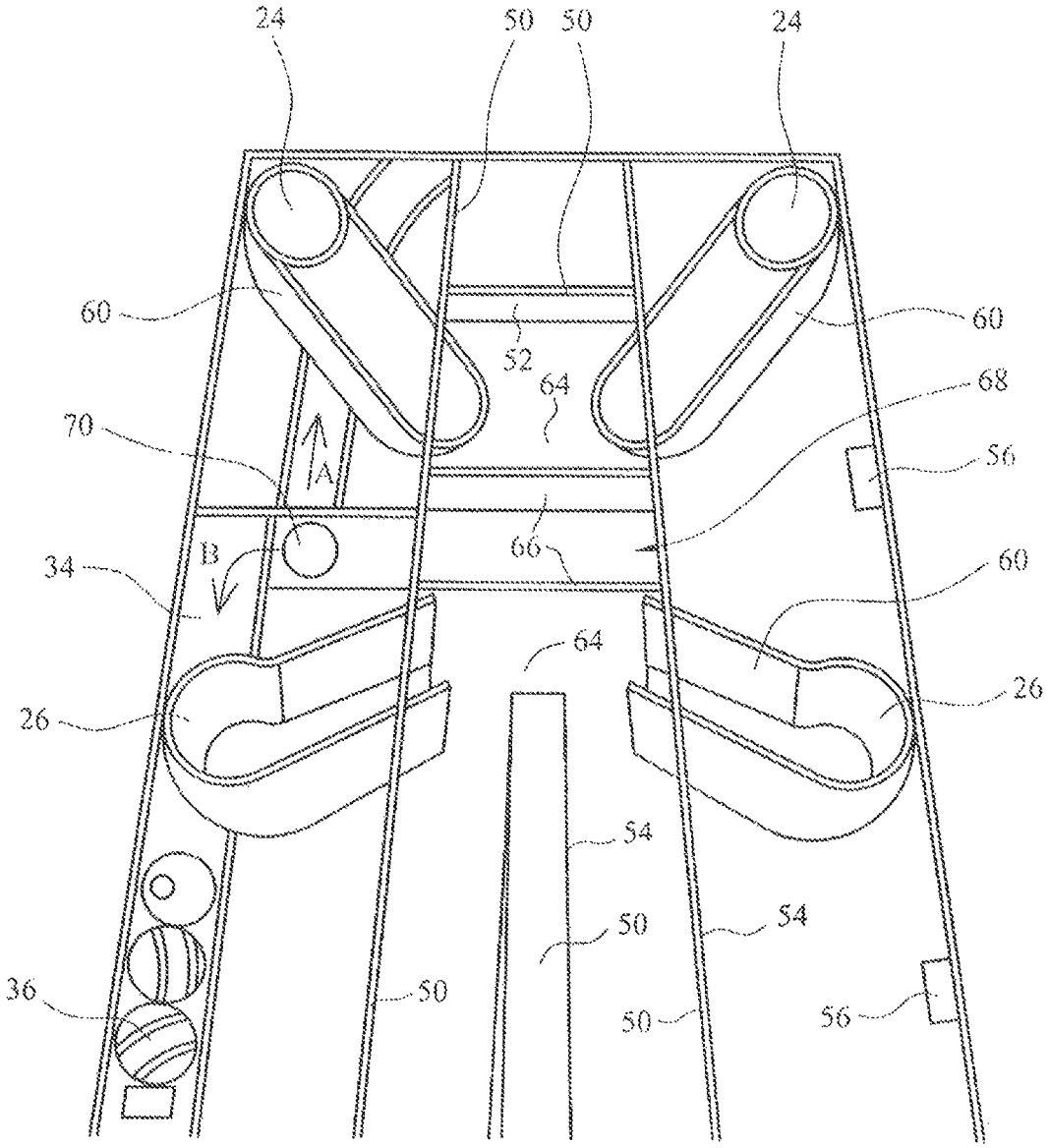
FIG. 2 PRIOR ART
FIG. 2 is a representation of a ball return mechanism and bed-support within the pay-per-game cabinet pool dining table of FIG. 1.

Turning to FIG. 2, there is shown a representation of an internal ball return mechanism and bed-support within the pay-per-game cabinet pool dining table of FIG. 1. FIG. 2 is a partial view showing about half of an entire pool table. The bed 14 is not present in FIG. 2, which bed would otherwise rest on upper surfaces 50 of lateral and longitudinal intersecting cross-members 52, 54 and/or ledges 56 that are fixedly secured into sides of the cabinet 22. For the sake of simplicity, only some of these cross-members and ledges are shown.

What is noticeable in FIG. 2 is that a closed end gully 60—typically formed in a plastics material and having a generally U-shaped cross-section—is located beneath each pocket. Each gully is dimensioned to allow a pool ball to be channel from the entrance of the pocket and is inclined towards a lip that permits a ball, under gravity, to be rolled towards and then cascaded into a central collection box 64 defined between intersecting cross-members 52, 54. The gullies will generally extend through the cross-members to ensure that balls are always channeled into the central collection box 64.

A floor of the central collection box 64 is inclined towards an edge 66 that defines a drop into a lateral ball distribution runner 68 that is relatively lower, i.e. beneath a floor level, of the central collection box 64. The lateral ball distribution runner 68 is therefore another channel at a lower level within the cabinet, with this ball distribution runner generally splitting the central collection box 64 into two inclined sections having respective surfaces that both feed a ball into this ball distribution runner 68.

The distribution runner 68 is arranged to move pocketed balls towards a ball separation device 70 (such as a dimensioned hole or a gate) that functions to separate the cue ball from colored balls, with the ball separation device 70 again on an incline and configured to send the cue ball in the direction (Arrow "A") of a free-return box (at the end of the table not shown) and to send colored (i.e. object) balls 36 to the ball reservoir 34 along an alternative path (Arrow "B").

Figure 3:
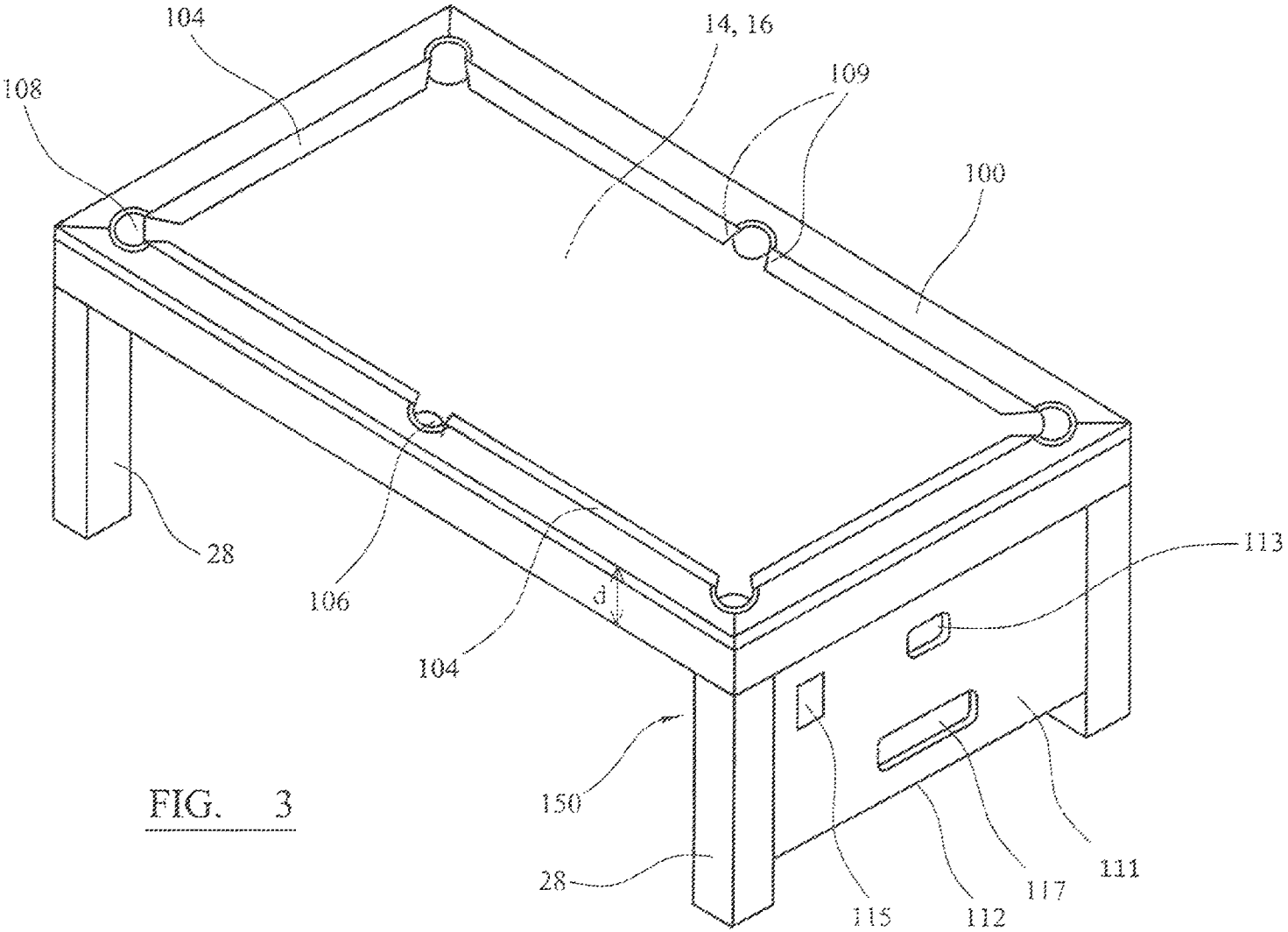
FIG. 3 is a perspective view of a pool table according to a preferred embodiment of the present invention.

FIG. 3 is a perspective view of a pool table 100 according to a preferred embodiment of the present invention. A description of the playing surface, e.g. side aprons, cushions, pocket locations and general construction resembles the prior art so will not be discussed in detail. However, as is shown in FIG. 3, the table 100 includes a baize covered bed 14, 16, top and side cushions 104 located along the periphery of the playing surface of the bed and positioned between pockets 106-108 cut into the bed 14. Conventionally, the cushions have angled end edges that define jaws 109 to each pocket. In contrast with the prior art, the table of FIG. 3 includes an end ball return mechanism that, preferably, includes a ball separation device hidden behind end/front fascia board 111. The ball separation device returns the cue-ball to a free-return box 113, whereas colored balls are accessed (eventually, subject to payment (if any) in a coin acceptor or bank card reader 115) from a ball picking slot 117.

However, as shown in FIGS. 3 to 6, a novel ball collection layer and gravity-drop ball separation, collection and dispensing sub-system mean that a relatively shallow table (with an approximate depth of between about 12 cm to 18 cm (4.7 in to 7.1 in)) can be realized by the present invention and, furthermore, such as gravity-based system can also include an effective ball return feature to one end of the pool table, with edge-located inclined feed gullies (in a layer beneath the table's bed) connecting together multiple pockets to delivery balls along a path along a side edge of the table to the ball separation, collection and dispensing sub-system. The system of the present invention therefore allows for a less bulky pool dining table solution that can support pay-per-game play. In the preferred embodiment, there is no central collection box for balls. Rather, the gullies that interlink/interconnect pockets along principal (longest) sides of the pool dining table 100 function to run any pocketed ball along but beneath side edges of the table (relative to a central axis 107). The length of each gully allows a ball to acquire a reasonable amount of speed and momentum (so not to stall within the gully) following its drop into, for example, one of the middle pockets.

Figure 4:
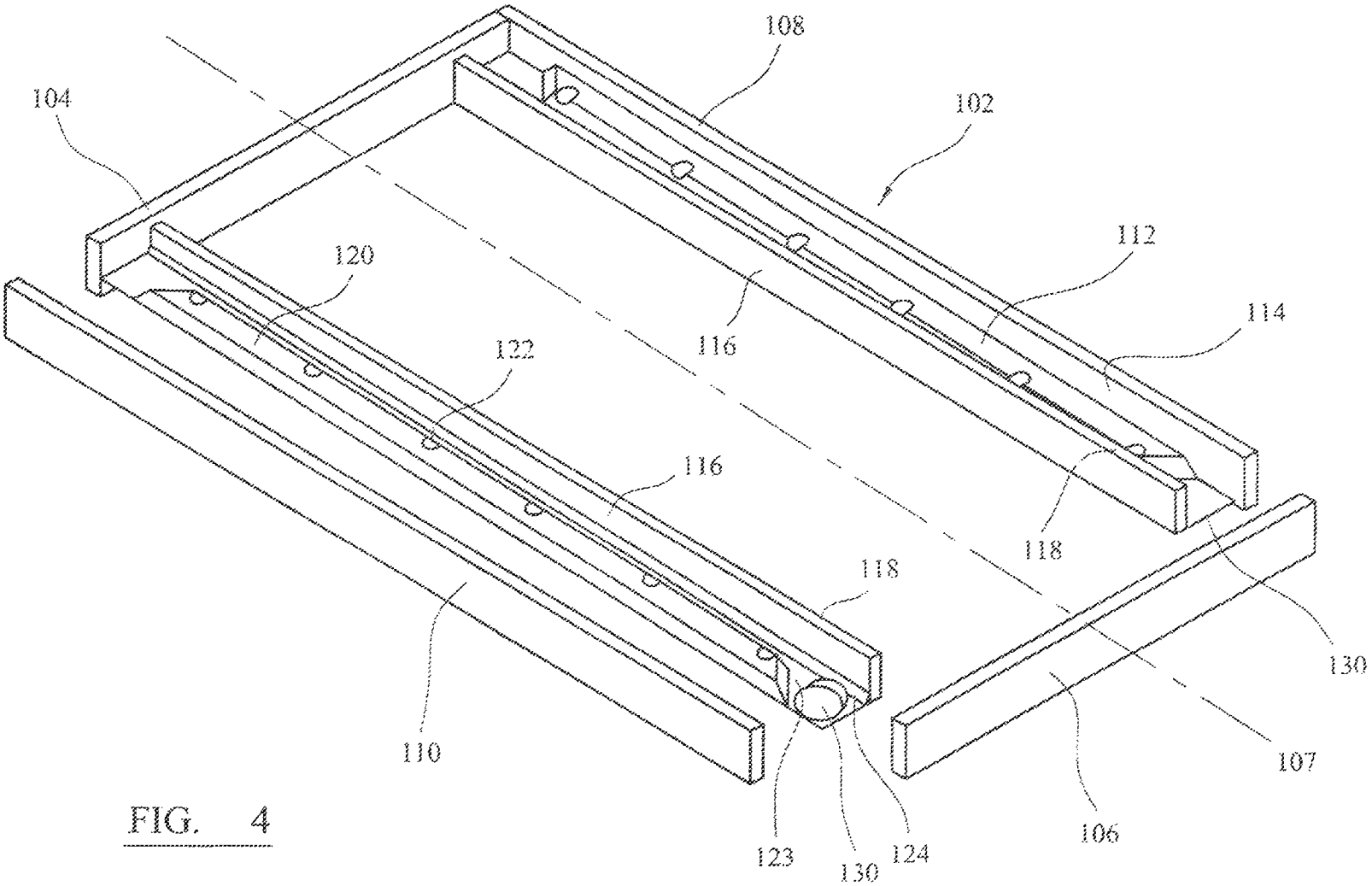
FIG. 4 is an exploded view of a preferred ball collection layer of the pool table of FIG. 3.

Turning to FIG. 4, there is shown an exploded view of a preferred ball collection layer 102 of the pool table of FIG. 3. This layer 102 sits immediately below the bed of the pool table 100 and may be the layer on which the bed is directly supported (or at least mechanically coupled).

Assuming, for the sake of explanation, that the pool dining table is conventionally shaped as a rectangle (rather than another regular polygon having at least six sides and an even number of sides), the ball collection layer 102 includes four periphery aprons 104, 106, 108, and 110. A first parallel pair of these aprons define a baulk (or "kitchen") end at the bottom end 104 of the table and a top end 106 of the table. Two parallel side aprons 108-110, either side of a major longitudinal axis/centerline 107 of the table, define sides of the pool table and connect the bottom end 104 and top end 106 together. Inside of each side apron is an inclined gully 112 that includes a downward slope at an angle of between about one and five degrees sloping from the bottom end of the table and the top end of the table. An outer side 114 of each gully 112 is defined by an inner surface of each respective side apron 108-110. An inner surface of each gully 112 is defined by an upright support board 116 that runs from the top end to the bottom end and which upright support board 116 has an upper surface 118 on which the bed (not shown) may rests. The gully is sized to allow pool balls to run therealong towards the ball separation, collection and dispensing sub-system 150 (described below and shown particularly in FIGS. 5 and 6) at one end (usually the end remote from the kitchen/baulk end of the table) of the table 100.

Preferably, each gully 112 may also include an inclined ball deflector board 120 that slopes inwardly from an outer edge of the table 100 towards the major longitudinal axis/centerline 107. This inclined ball deflector board may define a channel 123 that narrows (as the ball descends towards the ball separation device) to a width that is approximately that of a single pool ball's diameter. Of course, the configuration of the ball deflector board 120 is a design option although its function is to direct balls effectively downwards into the channel and then into the ball separation device at a cascading exit 130 positioned at the lowest end of each gully. The cascading exit 130 feeds balls into the ball separation device typically through a drop or inclined surface that is relatively lower than each gully 112. The cascading exit 130 may be realized by a hole dimensioned to allow a ball to drop directly through the hole in onto a switchback runner that is an integral part of the ball separation, collection and dispensing sub-system 150.

Preferably, each of the two gullies is mirror-symmetric in shape and edge position relative to the major longitudinal axis 107 of the pool table. The pool table's depth d (from an upper surface of the cushion to the bottom of the side apron) is typically in the range of about 14 cm to 18 cm (5.5 in to 7.1 in) for a standard English seven-foot (2.14 m) pool table, with a floor to bottom edge clearance (to the base of the apron) of about 56 cm to 63 cm (22 in to 25 in).

The channel and cooperating slopes within the gully 112, including an optional lower base ledge deflector 124 joining the gully's sloping base to the upright support board 116, are designed to see a pocketed ball relayed downhill for processing and sorting in the ball separation device. Each gully may further include one or more and usually multiple liquid drain holes 122. These drain holes 122 may be formed in the ball deflector board 120 or in the gully itself and are present to permit any liquid that has been spilt down the pockets to be effectively drained away to keep each gully free from liquid and the balls freely moving therein. The optional drain holes 122 act to reduce the likelihood of pooling or residual stickiness that could otherwise be exacerbated from pooling and/or evaporation of a pooled (rather than a drained) spillage within the gully.

Pockets (into which, in play, pool balls are sunk/pocketed) are cut into the bed at its corners and also at a central middle position along the bed's major longitudinal axis 107 are positioned substantially directly over the gullies 112. Once located over the gullies 112, the bed has a height separation above component elements (such as either the base of the gully or the ball deflector board 120) that is sufficiently sized with a clearance that allows for the unencumbered free-running of the balls 36 within the gully.

More usually, the bed of the table will be supported on a steel framework that is sits on/is mechanically coupled to the legs (either directly or indirectly through other support structure of the table, e.g. the side aprons). The fixing of the bed to the table is well-known in the art and this fixing does not affect the concept of a single end ball-return system.

The side aprons extend above the upper surfaces 118 of the support boards, thereby allowing for the pool table's cushions to be fixed internally thereto to define, in combination with the baize-covered bed 14, 16, the playing surface of the pool table 100. In the event that the pool 100 table of FIGS. 3 to 6 realizes a pool dining table, then the cushions and bed are covered by one or more table top portions (e.g. element 12 as shown in FIG. 1).

Figure 5:
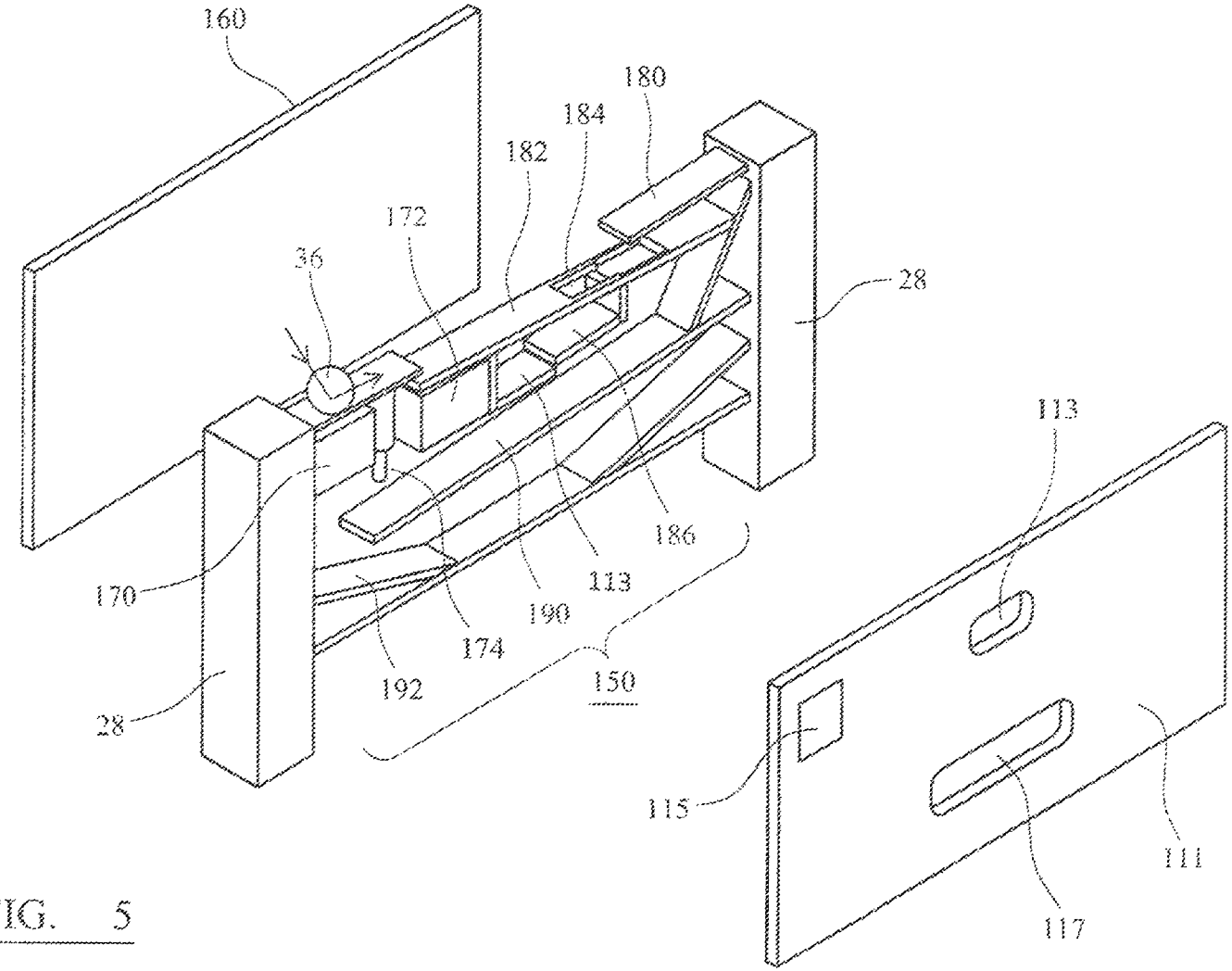
FIG. 5 is an exploded view of a preferred gravity-drop ball separation, collection and dispensing sub-system of the pool table of FIG. 3.
Figure 6:
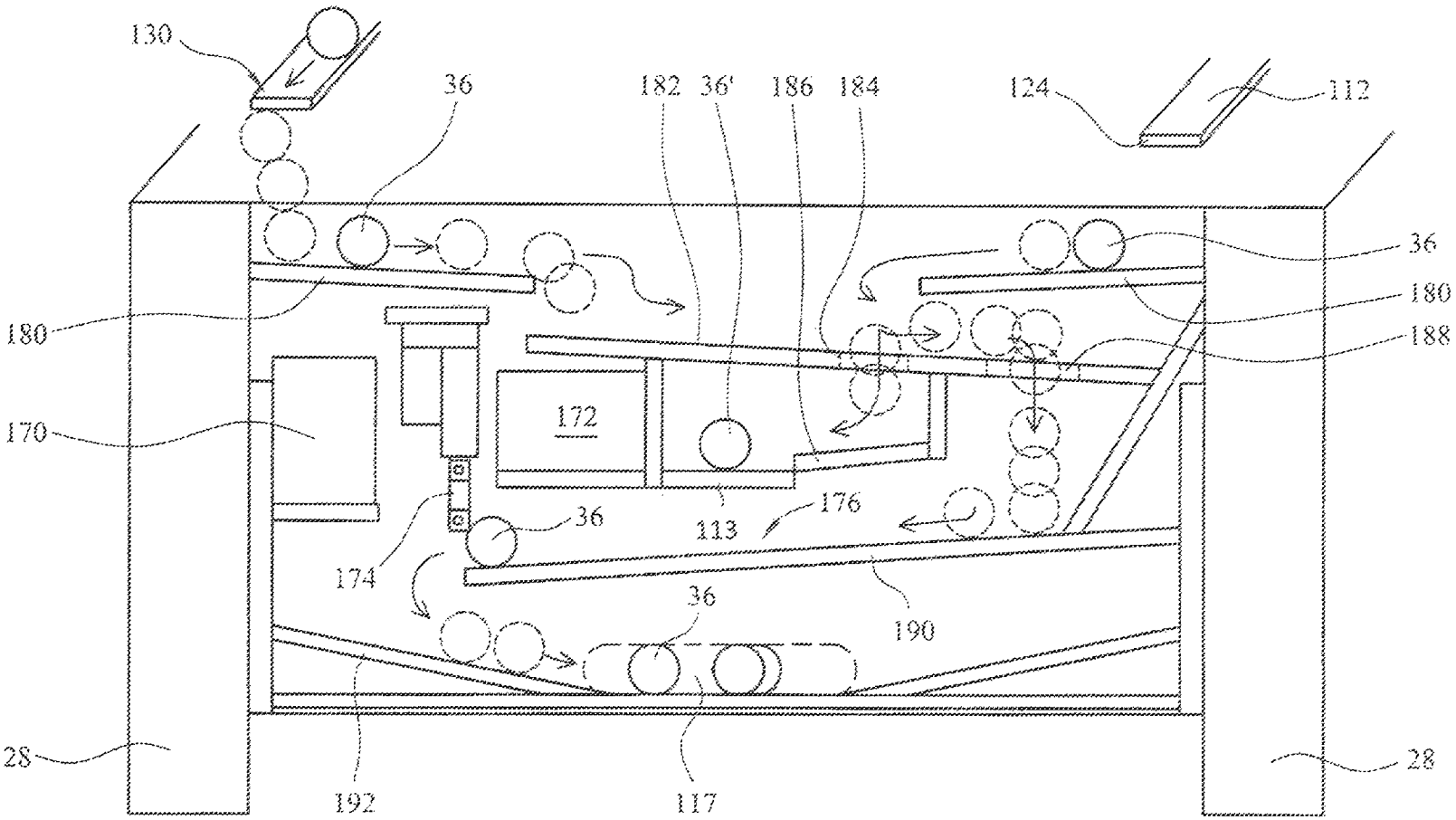
FIG. 6 is an end view of the gravity-drop ball separation, collection and dispensing sub-system of FIG. 5, the end view showing relative channel inclinations.

FIG. 5 is an exploded view of a preferred gravity-drop ball separation, collection and dispensing sub-system 150 of the pool table of FIG. 3 (and FIG. 4). FIG. 6 is an end view of the gravity-drop ball separation, collection and dispensing sub-system 150 of FIG. 5, the end view showing relative inclinations with a vertical stacking of inclined and descending balls runs. These figures will be discussed commonly below.

Preferably, the single-end ball separation, collection and dispensing sub-system 150 is located transversely/laterally between (or at least partially between or in close proximity to) end legs 28 of the pool table 100 along a shorter side of the pool table. Positioning the single end ball separation, collection and dispensing sub-system 150 at this point maximizes the space beneath the pool dining table 100 (e.g. to accommodate chair and seating) and provides access to the ball picking slot 117. Both the free-return box 113 and the ball picking slot 117 are at a common end of the pool table 100 of the preferred embodiment.

FIG. 5 shows the front fascia board 111 having strategically positioned holes that provide access to both the free-return box 113 and the ball picking slot 117. A second rear fascia panel 160 seal the back of the ball separation, collection and dispensing sub-system 150. The front fascia board 111 includes the optional user payment interface with associated control electronics and mechanics (for ball release) hidden internally—and sandwiched between—the fascia board 111 and the second rear fascia panel 160. For the sake of clarity, wiring for the electronics 170 and the mechanical connection is not explicitly shown, but it represented schematically in the drawings. Power (for example) for the payment card reader 115 and other equipment (such as an electrically-controlled telescopic rod or a mechanical gate that is selectively operable to release colored balls retained in a ball reservoir 176 therebehind (hereinafter the "ball retainer and release mechanism 174")) is supplied by a power supply 172. The power supply 172 may be a rechargeable battery or a mains-driven power supply.

FIG. 6 shows the path of colored pool balls 36 and the cue ball 36' through a vertical stack of inclined and descending balls runs that double-back on themselves from one side of the end to the pool table to the other side. The stack's depth is marginally wider that the diameter of the pool balls used in the game. Once assembled with the front fascia board and the rear facial panel, the vertical stack of inclined and descending balls runs is securely enclosed with access to pocketed balls restricted to the free-return box 113 or the ball picking slot 117.

When a ball, regardless of whether it is a colored ball 36 or a cue ball 36', is pocketed and channeled via the gully to the cascading exit, the ball initially drops on a first inclined ball run 180 that is angled towards the center of the ball separation, collection and dispensing sub-system 150. This first ball run delivers the ball to a common second downwardly inclined ball run 182 that is inclined towards one of the two sides (and in the direction of the table's corner leg 28). This second ball run includes a ball separator 184. The ball separator may simply be a succession of slots or holes of differing width or diameter, with these holes allowing a larger colored ball 36 to be separated from a smaller cue ball 36'. If the balls are the same size, such as in the American version of pool, then the ball separator 184 may be another electronically controlled gate, trap door or the like that is controlled to separate a differentiated colored ball from the cue ball. Regardless, the ball separator 184 drops a filtered-out cue ball onto a third downwardly inclined ball run 186 that feeds into the free-return box 113. Of course, once separated, the third downwardly inclined ball run 186 may not be necessary since the geometry of the ball separation, collection and dispensing sub-system 150 may simply drop the cue ball directly into the free-return box 113. With respect to the now separated path for the colored balls, these are (for example) dropped through a wider selection hole or trap into the ball reservoir 176 preferably (or at least typically) realized by a fourth downwardly inclined ball run 190. At a lower end of this fourth downwardly inclined ball run 190 is the ball retainer and release mechanism 174 that selectively retains or releases the colored balls into a final drop and onto a fifth inclined ball run 192 that delivers the colored balls (subject to there being the ball retainer and release mechanism 174 or it being in its open position) to the ball picking slot 117. The ball retainer and release mechanism 174 in combination with the coin acceptor or bank card reader 115 regulates paid play and access to the colored balls 36.

Unless specific arrangements are mutually exclusive with one another, the various embodiments described herein can be combined to enhance system functionality and/or to produce complementary functions in the pool table's configuration. Such combinations will be readily appreciated by the skilled addressee given the totality of the foregoing description. Likewise, aspects of the preferred embodiments may be implemented in standalone arrangements where more limited and thus specific component functionality is provided within each of the interconnected—and therefore interacting—system components albeit that, in sum, they together support, realize and produce the described real-world effect(s). Indeed, it will be understood that unless features in the particular preferred embodiments are expressly identified as incompatible with one another or the surrounding context implies that they are mutually exclusive and not readily combinable in a complementary and/or supportive sense, the totality of this disclosure contemplates and envisions that specific features of those complementary embodiments can be selectively combined to provide one or more comprehensive, but slightly different, technical solutions.

It with, therefore, be appreciated that the above description has been given by way of example only and that modification in detail may be made within the scope of the present invention. For example, the single end return mechanism can be employed in other pool table shapes, such as regular six- or eight-sided regular polygons. Also, while the ball return mechanism has been described in the context of a pool dining table, the ball return mechanism could be used independently to reduce the overall weight of pool tables, including pay-per-game commercial slate-bed pool tables, in general. Equally, the present invention is not limited to the game of pool but could also be applied to other table ball games, such as snooker.

Furthermore, while a preferred embodiment has two symmetrical gullies that each interconnect multiple pockets and which run directly beneath those pockets at the edge of the table, it is possible for a single interconnecting edge gully to connect all pockets or the two edge gullies to not be mirror opposites in the major access 107 of the table. The compromise in a longer channel relates to the vertical drop achieved between the highest point of the gully's slope and the point at the cascading exit. With a shallower draft, ball speed and ball momentum are respectively slower and smaller, so delivery of the balls to the single end ball separation, collection and dispensing sub-system 150 is slowed if the depth of the table is not increased to accommodate a sufficient end-to-end slope (typically in the range of between about one to three degrees based on a table depth of about 14 cm (5.5 in)). Also, with a single gully (that snakes around the periphery of the table to connect all pockets through a narrow gully) or a non-four-sided rectangular table, the peripheral gully will include a corner which potentially slows ball progress towards the single end ball separation, collection and dispensing sub-system 150. While the corner may be rounded to minimize any slowing effect, it is clearly preferable for the gully to have a substantially straight downward run from its highest point to the cascading exit 130 thereof.

While the preferred embodiment is described with four legs, this need is optional. A central leg is a design option. In this instance, the ball separation, collection and dispensing sub-system nevertheless remains at one end (or a minor edge relative to a longer major edge) of the table.

What is claimed is:

1. A pool table having a first end and a second end and connecting sides that connect the first end to the second end, the pool table including:

a bed (14) into which is cut six pockets, with one of said six pockets positioned at each one of at least four corners defined at intersections between connecting sides and one of the first end and the second end;

a ball collection layer (102) beneath the bed (14), the ball collection layer including:

at least one downwardly inclined peripheral edge gully (112) interconnecting multiple pockets, the at least one peripheral edge gully located beneath multiple pockets thereby to collect, in use, balls (36) that fall into the pockets;

a cascading drop (130) at a lowest end of the at least one inclined peripheral edge gully (112), the cascading drop (130) nearest one of said first end and second end; and a ball separation, collection and dispensing sub-system (150) positioned at one of said first end and said second end, the ball separation, collection and dispensing subsystem (150) having:

at least one ingress point beneath the cascading drop (130);

a stacked arrangement of multiple downwardly inclined runners (180, 182, 190, 192) wherein a first one of said runners is beneath the at least one ingress point and wherein stacking of one runner over another runner causes a switchback; and a ball separation device arranged to differentiate between a cue ball and an object ball, the ball separation device configured to send a cue ball along a first path in the stack of runners (180, 182, 190, 192) towards a free-return box (113) and to send object balls (36) along a second path in the stack of runners (180, 182, 190, 192) towards a ball picking slot (117), wherein the free-return box and the ball picking slot (117) are accessible only at said end where the ball separation, collection and dispensing sub-system (150) is positioned.

2. The pool table of claim 1, further comprising:

a ball retainer and release mechanism (174) cooperating with the ball separation, collection and dispensing subsystem, the ball retainer and release mechanism (174) located in the second path and wherein the ball retainer and release mechanism (174) is arranged to selectively retain object balls behind a barrier to prevent such retained object balls from being accessible, prior to release of the barrier, from the ball picking slot (117).

3. The pool table of claim 2, further including a payment device (116) arranged to receive payment for a game, the payment device operatively coupled to the ball retainer and release mechanism (174) and wherein, upon receipt of payment by the payment device (115), the barrier is opened to release retained object balls into the ball picking slot (117).

4. The pool table of claim 1 wherein the ball collection layer includes two edge gullies that are mirror-images of one another along a major longitudinal axis (107) of the pool table (100).

5. The pool table of claim 1, wherein the pool table is a pool dining table having at least one flat dining panel removably locatable over the bed (14).

6. The pool table of claim 1, wherein the ball separation, collection and dispensing sub-system (150) is located between a pair of legs, said legs being at corners of a short side of the pool table.

7. The pool table of claim 1, wherein first path is different to the second path and the free-return box is physically distinct from the ball picking slot.

8. The pool table of claim 1, wherein the at least one peripheral edge gully includes a plurality of drain holes (122).

9. The pool table of claim 1, wherein the at least one peripheral edge gully includes an inclined ball deflector board (120) that slopes inwardly from an outer edge of the table (100) towards a centerline (107) of the table.

10. The pool table of any preceding claim, wherein the inclined peripheral edge gully includes a channel (123).

11. The pool table of claim 4, wherein each one of the two edge gullies are straight and commonly join together two corner pocket and a middle pocket intermediate between the two corner pockets.

* * * * *